United States Patent [19]

Lowe et al.

[11] Patent Number: 4,847,536

[45] Date of Patent: Jul. 11, 1989

[54] POWER REDUCER FOR FLUORESCENT LAMPS

[75] Inventors: Archie H. Lowe; Addison Gooding; William S. Culwell, all of Houston, Tex.

[73] Assignee: Duralux Industries, Inc., Houston, Tex.

[21] Appl. No.: 933,019

[22] Filed: Nov. 20, 1986

[51] Int. Cl.[4] ..... H05B 41/16

[52] U.S. Cl. ..... 315/127; 315/97; 315/106; 315/107; 315/185 R; 315/187; 315/277; 315/278; 315/282

[58] Field of Search ..... 315/106, 107, 97, 307, 315/308, 309, 127, 206, 279, 119, 290, 291, 100, 96, 185 R, 277, 282; 361/35

[56] References Cited

U.S. PATENT DOCUMENTS

| | | | |
|---|---|---|---|
| 3,500,128 | 3/1970 | Liepins | 315/277 |
| 3,954,316 | 5/1976 | Luchetta | 315/96 |
| 4,082,981 | 4/1978 | Morton et al. | 315/97 |
| 4,135,115 | 1/1979 | Abernethy et al. | 315/97 |
| 4,613,792 | 9/1986 | Kroessler | 315/97 |

*Primary Examiner*—Howard W. Britton
*Assistant Examiner*—Mark R. Powell
*Attorney, Agent, or Firm*—Neal J. Mosely

[57] ABSTRACT

An attachment is provided for connection in fluorescent lamp circuits for reducing power consumption. The attachment is particularly designed for use with fluorescent lamp circuits having an encapsulated ballast including a transformer and capacitance. The attachment includes an isolation transformer with a capacitor and a resistor connected across the transformer, and an inductance connected in line with the primary of the ballast transformer with a resettable thermal switch connected to shut down the ballast transformer in response to high current overload conditions, and a surge voltage protection circuit connected through the thermal switch to shut down the ballast in response to a ballast power factor capacitor failure. The ballast and power reducer cooperate to produce a substantially square wave output resulting in increased system efficacy, reduced lamp lumen depreciation, and increased lamp life.

24 Claims, 1 Drawing Sheet

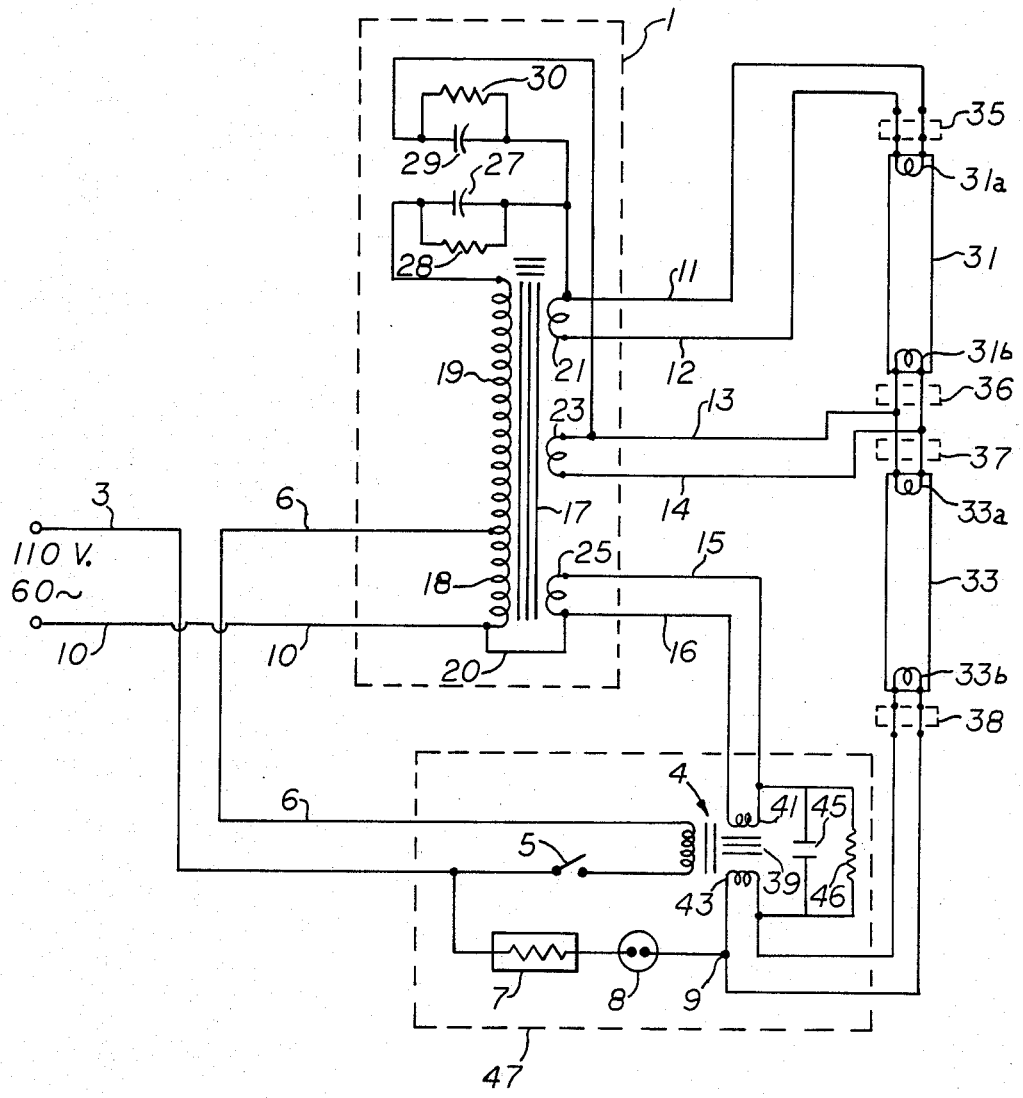
1
30
29
27
28
11
12
13
14
15
16
17
18
19
20
21
23
25
3
6
110 V.
60~
10
10
35
31a
31
31b
36
37
33a
33
33b
38
4
41
45
5
39
43
46
7
8
9
47

POWER REDUCER FOR FLUORESCENT LAMPS

BACKGROUND OF THE INVENTION

1. Field of the Invention

This invention relates to new and useful improvements in methods or reduction in power consumption in fluorescent lamps and to attachments for use in electric circuits for fluorescent lamps which accomplish such reduction in power consumption.

2. Brief Description of the Prior Art

Numerous stores, offices and homes employ fluorescent lighting fixtures to provide desired illumination. Many of these fluorescent lamp fixtures employ the long cylindrical fluorescent type lamp known as the "rapid start" type which contains heater filaments. Such lamps are operated in the fixture individually or in groups of two or more, electrically connected in series effectively and operated from a high reactance transformer and capacitor combination, sometimes referred to as a "ballast," which provides the high starting voltages required by these fluorescent type lamps the current limited lower operating voltages and the filament current and voltages. By design the lamps and the ballasts are matched together so that the lamps operate at maximum efficiency and hence, by design, a certain electrical current effectively flows through the lamp circuit to provide full lamp brightness. Electrical power is obtained via the building wiring from the local power company or utility and is supplied to the ballast input.

Most fluorescent lighting systems are of the rapid start type in which the lamp electrodes are preheated for a short time by low voltage followed by applying high voltage to fire the lamp. Such systems utilize a rapid start ballast having a step down transformer for heating the lamp electrodes and autotransformer for firing the lamp. The ballast conventionally has one or more capacitors connecting the secondary winding of the autotransformer to the secondary winding or windings of the step down transformer and resistors connected in parallel with each such capacitor. The ballast, including the transformers, capacitors and resistors, is usually encapsulated in resin, asphalt, or plastic with color coded leads extending therefrom for connection to the power source and to the fluorescent lamp tube.

For many years, there has been a conservation move to reduce electrical consumption. In particular, some electrical utilities have been requiring consumers, such as the industrial, store and factory users, to reduce electrical power consumption by 15% or more or suffer a financial penalty or, possibly, cut-off of electrical service. To meet this requirement, business has resorted to many expedients resulting in some such savings with unavoidable individual inconvenience. Thus the hot water has been turned off; the temperatures for air conditioning are fixed for a higher than normal temperature; heating is limited; and, most relevant to the present invention, the lights are "turned off".

If each fluorescent lamp fixture were controlled by a single associated wall-mounted "on-off" switch and only selected lamp units were turned off, the practice of that expedient and the concurrent power savings is simple. In practice however, long "banks" of fixtures are controlled by a single "on-off" switch. Hence if the switch is turned to "off" an entire area may be placed in darkness. Obviously that condition is impractical in a business or factory.

Instead the procedure which has been adopted is the simple expedient of removing alternate pairs of the fluorescent lamps from the overhead fixtures. In a sense this cuts down the illumination in an area to one-half of some other fraction less than previously obtained with all lamps in operation. Thus although lighting is reduced, the area remains sufficiently illuminated to permit persons to continue performance of their duties.

In the example given, although the amount of illuminations is reduced in half by removal of half of the lamps, the electrical consumption it is found is not reduced in half as logic might suggest. What is overlooked in the practice of this expedient is although the "electrical load," i.e., the fluorescent lamps, is removed, the ballast transformer remains connected in circuit in the electrical power system. Consequently the primary of the ballast remains in the electrical system as an inductively reactive electrical load. As is known to those skilled in the art, the magnetic hysteresis action inherent in the iron core of the transformer consumes some minor amount of power, technically known as "core loss." In addition, the reactive current supplied the ballast transformer is of a significant level.

As is familiar to those skilled in the art, large reactive currents flowing in the on-premises electrical system lines create resistive heating losses therein and thus waste electrical energy. Not only is this undesirable on the premises but it is also undesirable from the standpoint of the utility company, inasmuch as these large reactive currents must be fed into the electrical lines over the utility company's electrical lines and distribution transformers and this too can be overheated. For example, in one test, two 40-watt rapid-start type lamps were removed from their sockets in the lamp fixtures and 38 volt-amperes are measured at the ballast input. This volt-ampere is lower than the normal level of 102 volt-amperes, but is larger than the desired reading of zero if the ballast input was disconnected from the power line. The reader may make reference to the literature concerning "power factor correction" and measures normally taken by the utility companies and others to eliminate reactive currents of this type from electrical distribution lines and maintain the power factor of the line current at approximately "1." Thus not only is the consumer deprived of desired light, but savings of electricity are not as great in practice as one might expect from that privation.

If the electrical connections to the ballast were disconnected from the power line, the problem of continued reactive current is avoided entirely. However to do so is a more difficult task than simply removing the fluorescent lamps from their sockets and also makes it more difficult to return those lamps to service.

In recent years several improvements have appeared in the patent literature and some have appeared on the market for reducing electrical energy consumption in fluorescent lighting systems.

Luchetta U.S. Pat. No. 3,954,361 discloses an attachment for use in two-lamp fluorescent lighting fixtures comprising an isolation transformer and a capacitor connected across the transformer to reduce power consumption of the fluorescent lamps.

Abernathy U.S. Pat. No. 4,135,115 discloses an attachment comprising an isolation transformer and two capacitors connected across the transformer on opposite sides, and a resistor connected in parallel with one of the capacitors to reduce power consumption of the fluorescent lamps.

Other U.S. patents, viz. U.S. Pat. Nos. 4,082,981; 4,163,176; 4,256,993; 4,339,690; 4,388,564; 4,435,670; and 4,501,992 disclose other variations on the basic circuit of Luchetta, i.e. an isolation transformer and a capacitor connected across the transformer to reduce power consumption of the fluorescent lamps.

This prior art and the products commercially available today suffer from the deficiency that they produce a triangular wave pattern output to the lamps and do not include resettable means for shutting down the system on failure of the ballast transformer or ballast power factor capacitor.

SUMMARY OF THE INVENTION

It is one object of the invention to provide a new and improved power-reducing circuit as an attachment or modification to a rapid-start fluorescent lighting system which reduces power consumption.

Another object of the invention is to provide an inexpensive attachment for lamp systems of the rapid-start type which reduces power consumption in the lamp system without requiring removal of any of the fluorescent lamp tubes.

Another object of the invention is to provide an improved method of reducing power consumption in a fluorescent lamp system without requiring removal of any of the fluorescent lamp tubes.

Another object of the invention is to provide an inexpensive attachment for lamp systems of the rapid-start type which reduces power consumption in the lamp system without requiring removal of any of the fluorescent lamp tubes by converting the ballast output to a substantially square wave form.

Still another object of the invention is to provide an inexpensive attachment for lamp systems of the rapid-start type which reduces power consumption in the lamp system without requiring removal of any of the fluorescent lamp tubes by converting the ballast output to a substantially square wave form, and includes resettable means for shutting down the system on failure of the ballast transformer or ballast power factor capacitor.

Other objects of the invention will become apparent from time to time through out the specification and claims as hereinafter related.

The foregoing objects and other objects of the invention are accomplished by providing an attachment for connection in fluorescent lamp circuits for reducing power consumption. The attachment is particularly designed for use with fluorescent lamp circuits having an encapsulated ballast including a transformer and capacitance. The attachment includes an isolation transformer with a capaciator and a resistor connected across the transformer, and an inductance connected in line with the primary of the ballast transformer with a resettable thermal switch connected to shut down the ballast transformer in response to high current overload conditions, and a surge voltage protection circuit connected through the thermal switch to shut down the ballast in response to a ballast power factor capacitor failure. The ballast and power reducer cooperate to produce a substantially square wave output resulting in increased system efficacy, reduced lamp lumen depreciation, the increased lamp life.

BRIEF DESCRIPTION OF THE DRAWINGS

The FIGURE illustrates schematically the attachment and a modified lighting system of the invention for reducing power consumption in fluorescent lighting fixtures.

DESCRIPTION OF THE PREFERRED EMBODIMENT

In the preferred embodiment of the invention as shown in the drawing, there is schematically illustrated the combination of a conventional ballast for starting and operating two rapid-start lamps, although, with obvious modifications, it may be used in one lamp systems or systems with more than two lamps. As is well known, the ballast 1 physically appears as a sealed elongated rectangular metal container, represented by dash lines, and a plurality of insulated electrical leads extending therefrom usually through openings in the container ends. The ballast container and enclosed circuit is usually encapsulated by filling with asphalt or a potting resin.

The ballast has insulated electrical leads designated 6, 10, 11, 12, 13, 14, 15 and 16 extending therefrom as seen in the drawing. The ballast transformer 17 is typically a high leakage reactance autotransformer and step-down transformer combination of conventional structure, which contains a core of magnetic material represented by three parallel lines, a primary winding 18, connected as illustrated to the power input leads 6 and 10, a high voltage secondary winding 19, connected electrically in autotransformer relationship with the primary and magnetically in high leakage reactance relationship with the primary, and three additional step-down secondary windings, sometimes called "filament windings," 21, 23, and 25.

The windings are formed of electrically insulated wire containing a predetermined number of wire turns and in which the number of turns in the secondary 19 is significantly larger than those of the primary to define a "turns" ratio therebetween to provide a "step up" voltage relationship between secondary 19 and primary 18 and the turns in each of secondaries 21, 23, and 25, substantially identical to one another, is significantly less than the turns of the primary so as to define a "turns ratio" therebetween substantially less than 1 to provide a "step down" voltage relationship between primary 18 and each of secondaries 21, 23 and 25.

A first (power factor) capacitor 27 is connected electrically in series with one end of secondary 19 and secondary 21 and a resistor 28 of high value is connected in parallel circuit across this capacitor. A second (starting) capacitor 29 is connected electrically in series between capacitor 27 (and secondary 21) and secondary 23, and a high value resistor 30 is connected in parallel circuit across this capacitor. As previously noted, the foregoing elements as illustrated are enclosed within the ballast container 1, and impregnated with an encapsulating material, such as asphalt, a potting resin or the like, and sealed. As a practical matter, the aforedescribed elements within ballast container 1 are inaccessible.

Many conventional rapid-start-type lamps are operated in pairs from a single ballast, such as lamps 31 and 33. The lamps physically appear as long cylindrical glass tubes and contain a filament, sometimes termed a heater or cathode, at each end designated 31*a* and 31*b* for lamp 31, and 33*a* and 33*b* for lamp 33.

The lamps have two electrical prongs or terminals extending from each end, with one prong connected to a corresponding end of the associated lamp filament. The lamp terminals are inserted into corresponding electrical sockets in an overhead lamp fixture, not illustrated, which physically supports the lamps and places the electrical connection thereto in the illustrated electrical circuit.

For purposes of clarity, four electric sockets, 35, 36, 37 and 38, are shown in the drawing. Electric leads 15 and 16 in circuit with secondary filament winding 25, extend from the encapsulated ballast, and are connected electrically through the terminals of electrical socket 38 to the corresponding terminals of lamp filament 33*b*. Electrical leads 13 and 14 are in circuit with secondary filament winding 23, extend from the encapsulated ballast 1, and are connected through the terminals of electrical sockets 36 and 37 in electrical parallel circuit to the corresponding terminals of the lamp heaters 31b and 33a.

The power reducing attachment is generally designated 47 and includes a small isolation transformer 39 as in the Luchetta patent and some of the other prior art. The transformer has a magnetic core represented by three lines, a primary winding 41 and a secondary winding 43. The primary winding is formed of a predetermined number of turns of insulated electrical wire and the secondary is formed of at least twice the number of turns of insulated wire as the primary winding. This transformer construction suitably is of any core or shell type in which one of the windings is wound atop and insulated from the other of the windings in a single coil form, and the coil form is mounted on the magnetic iron core.

Electric leads 15 and 16 connected to the ends of secondary filament winding 25, extend from encapsulated ballast 1, in circuit with primary winding 41. Secondary winding 43 is connected through socket 38 in circuit with heater 33*b* of lamp 33. A capacitor 45 and a resistor 46 are connected in parallel circuit between winding 41 and winding 43. Inductor 4 is positioned adjacent to transformer 39 and is connected through the normally closed contacts of thermal reset switch 5 and through wire 3 to the power source. The other side of inductor 4 is connected to wire 6 leading to one side of the transformer winding 18. The other side of the power source is connected by wire 10 to the other side of transformer primary winding 18. Thermal reset switch is a bimetal switch 5 with an electric heater coil 7 connected in parallel therewith. Heater coil 7 is connected to one side of a surge voltage protection tube 8, the other side of which is connected as at 9 to the secondary winding of isolation transformer 39.

The inductor 4, which is connected in the power circuit for primary 18 of ballast transformer 17 introduces an inductive reactance into the current powering ballast transformer 17 and, together with capacitors 27 and 45, functions to limit current while changing the wave pattern for current powering the fluorescent lamps. With the combination of inductive and capacitive reactance produced when this attachment is used as described, the AC output to the fluorescent lamps is nearly a square wave pattern rather than the triangular wave pattern produced with the power reducer of the Luchetta patent or most power reducers manufactured and sold commercially today.

OPERATION

In systems having only the ballast and lamp combination, electrical leads 15 and 16 are connected to the two terminals of socket 38 so as to be placed directly in electrical connection with corresponding ends of filament 33b. In using this invention, leads 15 and 16 are detached from socket 38 and are connected to transformer 39 and to capacitor 45 in the manner illustrated and previously described.

In the operation of this circuit, AC line voltage is applied across lines 3 and 10 and AC current flows through primary 18. By conventional transformer action the primary AC voltage is stepped down to filament voltage level and this filament voltage appears across each of the secondary AC outputs from each of the heater windings 21, 23 and 25. At this low voltage level, AC current is supplied from secondary 23 to each of filaments 31*b* and 33*a;* and AC current is supplied from secondary 21 over leads 11 and 12 to filament 31*a*. However the AC voltage across secondary winding 23 is connected by leads 15 and 16 to primary 41 of transformer 39.

Transformer 39 is an isolation transformer which transfers the AC across primary 41 and provides an AC voltage across is secondary winding 43 of the same or slightly higher voltage level. Resistor 46 provides a direct electrical circuit connection between the primary and secondary so that a ground path to the ballast is provided which enhances lamp starting. Resistor 46 also provides a safety function by bleeding capacitor 45 upon removal of power. Secondary 43 supplies current to filament 33b at the low AC voltage level.

Generally, it is necessary to employ a turns ratio between the turns of secondary 43 and the turns of primary 41 of 2:1 in order to obtain the same filament voltage level from winding 43 as previously obtained from ballast 21 prior to the conversion.

Obviously if higher voltages are desired for the lamp filament 33b or if a similar problem is encountered in a specific system, the turns ratio can be increased further. In this way the lamp filaments are heated for a sufficient period of time as desired with rapid-start type lamps to make the enclosed cathode electronically emissive.

By conventional transformer action the voltage is stepped up in secondary 19 and applied through capacitors 27 and 29 in lead 7, first across lamp 33. Additionally by auto-transformer action, the AC voltage applied to the primary 18 is stepped up to a higher voltage level which appears across secondary 19, typically on the order of 180 volts.

In the conventional autotransformer, a higher voltage is obtained by adding together the voltages of the primary and secondary, thus the voltage which appears between lead 20 and the transformer end of capacitor 27 by design under no-load conditions would equal the sum of the line and secondary 19 voltage. This high voltage is applied through capacitor 27 to filament winding 21 and there over lead 11 to one terminal of lamp 31.

This voltage is also aplied from the filament at end of capacitor 27 in the encapsulated ballast, through capacitor 29 and over the internal electrical lead to lead 13 associated with filament 31*b* of lamp 31 and filament 33*a* of lamp 33. Leads 15 and 16 are connected to the primary 41 of isolation transformer 39, the secondary 43 of which is connected to filament 33*b* of lamp 33. The remaining lead 20 is connected internally within ballast 1 to one end of secondary winding 25.

Under no-load conditions neither of lamps 31 and 33 are conducting current. In thi type of ballast arrangement it is apparent that the voltage initially appearing across lamp 31 is essentially zero since the voltage at capacitor 29 applied to lead 13 is essentially the same as the voltage appearing at the other side of that capacitor appearing at lead 11. However the full AC voltage is applied between teminals 33*a* and 33*b* of lamp 33.

Considering the voltage at lead 20 to be the common or neutral point, the voltage applied to the other lamp terminal via lead 13 is in excess of that required to start operation of lamp 33. Once lamp 33 begins to conduct current it changes from a very high impedance device to a very low impedance device reducing the voltage thereacross to a low level. In so doing, the voltage level at lead 13 and hence at filaments 31*b* is reduced, Inasmuchas the voltage at terminal 31*a* remains at a high level the voltage difference across lamp 31 is by design now at a sufficiently high level to cause the lamp to start conducting.

Once lamp 31 is conducting current, the supply of electrical current for powering lamps 31 and 33 follows an essential series circuit relationship with current flow from secondary 19 through capacitor 27 over head 1, filament 31a, through lamp 31 to filament 31b, through filament 33*a* of lamp 33 and through the lamp to filament 33*b*, capacitor 45 over lead 16 and lead 20 back to the secondary. Other more complex voltage and current relationships exist in this operating circuit which are known to those skilled in the art and other than the brief background information hereinbefore provided need to be discussed in further detail and the reader may make reference to such prior art materials and information, Basically the ballasts operate lamps 33 and 31 initially in sequence as described.

Ballast 1 is designed normally so that the high voltage output is higher than the starting voltage of an individual lamp, and when both lamps are in the operating condition and conducting AC current in serv and average AC current, limited by the capacitive reactive impedance of the series capacitor, such as capacitor 27, be at the level specified as optimal by the lamp manufacturer to maximize illumination from series connected lamps, such as lamps 31 and 33. Concurrently, the series capacitance effectively combines with the leakage inductances of the transformer to provide a high power factor considered electrically at the input, lines 6 and 10, to the transformer and hence what appears electrically to the power lines in an almost "resistive" electrical load, one in which the capacitive reactance and the inductive reactance are almost equal in value.

The insertion of an additional capacitance, such as capacitor 45, in series with capacitor 27 encapsulated in the ballast, by means of this invention, reduces the effective series capacitance in the lamp operating circuit. Hence the effective series capacitive reactance is increased. The impedance of the lamp operating circuit, considered from one end of the secondary 19, capacitor 27, capacitor 45, lamp 31, lamp 33, back to the other side of the winding, is thus increased and this necessarily reduces the AC current flow through the lamps.

With reduced lamp current the lamp illumination intensity decreases accordingly. With reduced lamp current it is apparent that the current supplied into ballast 1 is likewise reduced, but inasmuch as the transformer has both inductive and capactive reactance the power factor remains essentially near the ideal ratio of 1 to avoid generally reactive line currents.

It is of course known in the prior art that if the designer of the ballast 1 were to decrease the capacitance of capacitor 27, the impedance of the operating circuit is thereby increased and the AC current flowing through lamp 31 and 33 is reduced to that specified as optimum by the lamp manufacturer, and in so doing the ballast can be designed to accomplish the same purpose as the structure of my invention.

However, should such ballasts be poor it should be recognized that because all of the elements in the ballast container 1 are encapsulated in a hardenable asphalt material or potting resin, such a change is permanent and cannot thereafter be modified should optimum lamp current thereafter be desired and as a practical matter it would require replacement of the complete ballast transformer. This is obviously expensive.

Alternatively, in connection with present existing lamp fixtures containing properly designed ballast as heretofore mentioned, the elements of the ballast are permanently encased in the container in hardened asphaltic material or potting resin and hence it is almost impossible to tear apart the ballast container to either change the capacitor 27 to a smaller value or to insert additional capacitance in series therewith so as to reduce the overall capacitance. This is obviously more difficult and obviously expensive, and again should a change in that way be made one is back to the first case wherein it is expensive to change again back to the original component values should specified lamp current be desired thereafter.

The system shown in the drawing functions substantially the same as the system of Luchetta when used without the resistor 46 and inductor 4. The addition of the resistor 46 gives some improvement in performance and protection against shock when the system is shut down. The capacitor 45 is bled of through resistor 46 when the system is shut off. The output of either such system, however, is still a triangular wave pattern.

The addition of the inductor 4 in either of the power legs to the ballast transformer produces a better wave form or crest factor. Measurements made on the system shown in the drawing show that with only the ballast, the power output to the lamp is merely a triangular wave. This is produced primarily by the ballast power factor capaciator which changes the sine wave received from the utility company to a triangular wave.

Current crest factor, i.e. peak current divided by RMS current, is 1.4 for current as received from the utility. The ballast converts the current to a triangular wave with a crest factor of 1.8–2.0. The additional capacitance with the isolation transformer 39, the bleed resistor 46, and the inductance in the power leg to the ballast transformer changes the pattern to a substantially square wave pattern with a crest factor of 1.3–1.5 and a power factor of about 0.94.

The square wave pattern provides the most balanced supply of electrons to the lamps which significantly improves depreciation and lamp life, and increases efficacy. The peaks in the triangular wave pattern provide an oversupply of electrons to the lamps which increases destruction rates of the cathodes and phosphor. Changes in crest factor have an exponential effect on lamp life and depreciation. A change from 1.9 to 1.5 was found to result in an extra 20,000 hours of lamp life at three hours per start.

According to ballast manufacturers, about one-half of ballast failures result from power factor capacitor 27 shorting out. In this equipment, the surge voltage protector 8 is a gas discharge tube having insulated electrodes properly spaced by insulators and the tube filled with a rare inert gas at low pressure. The breakdown voltage is 230 V. plus or minus 15%. When there is a power factor capacitor failure, the voltage surge causes surge voltage protector 8 (Siemans SVP) to fire or discharge. The flow of current causes a rapid rise in temperature in heater 7 which causes bimetal switch contacts 5 to open and inactivate the power to ballast transformer 17. When heater 7 cools down, bimetal switch contacts close and the system can again be operated.

While this invention has been described fully and completely with special emphasis upon a preferred embodiment, it should be understood that within the scope of the appended claims the invention may be practiced otherwise than as specifically described herein.

We claim:

1. An attachment for connection between a rapid start ballast and a filament of a conventional rapid start fluorescent lighting fixture for reducing consumption of power and improving electrical waveform, and wherein said ballast includes an autotransformer having a primary winding, a secondary winding, and a plurality of step-down filament windings and a capacitor in circuit with the high voltage output side of said autotransformer, said attachment comprising an isolation transformer having a primary for connection to the secondary of said step down transformer and a secondary for connection to a fluorescent lamp filament, a capacitor connected between the primary and secondary of said isolation transformer, a resistor connected in parallel with said capacitor, an inductor for series connection with said primary winding of said autotransformer, and a thermally actuated overload switch connected in series with said inductor and operable to open in response to thermal or current overload condition.

2. A power reducing attachament according to claim 1 in which said thermally actuated overload switch is connected in series with said inductor and said ballast transformer and is operable to open in response to an excessive flow of current to said ballast capacitor or any thermal overload condition.

3. A power reducing attachment according to claim 1 in which said thermally actuated overload switch circuit includes a surge voltage protection tube permitting current flow on failure of said ballast power factor capacitor.

4. A power reducing attachment according to claim 1 in which said thermally actuated overload switch is connected in series with said inductor and said ballast transformer and is operable to open in response to an excessive flow of current to said ballast transformer or any thermal overload conditions, and includes a surge voltage protection tube permitting current flow on failure of said ballast power factor capacitor.

5. A power reducing attachment according to claim 1 in which said thermally actuated overload switch comprises a normally closed bimetal switch having its contacts in series with said inductor, and an electric heater resistor positioned in close proximity to said bimetal switch and connected from the powered side of said switch to the secondary of said isolation transformer and is operable to heat in response to an excessive flow of current to said ballast transformer resulting from failure of said ballast capacitor to open said bimetal switch contacts.

6. A power reducing attachment according to claim 1 in which said thermally actuated overload switch comprises a normally closed bimetal switch having its contacts in series with said inductor, and an electric heater resistor positioned in close proximity to said bimetal switch and connected from the powered side of said switch to the secondary of said isolation transformer and is operable to heat in response to an excessive flow of current to said ballast transformer resulting from failure of said ballast capacitor to open said bimetal switch contacts, and further including a surge voltage protection tube permitting current flow on failure of said ballast capacitor.

7. A power reducing attachment according to claim 3 in which said surge voltage protection tube comprises a hermetically sealed gas discharge tube having electrodes insulated and spaced a predetermined distance from each other and an inert gas at low pressure, whereby said tube permits current flow only on occurrence of a predetermined voltage drop thereacross.

8. A power reducing attachment according to claim 1 in which said thermally actuated overload switch is connected in series with said inductor and said ballast transformer and is operable to open in response to an excessive flow of current to said ballast transformer resulting from failure of said ballast capacitor or any themal overload conditions, and includes a surge voltage protection tube permitting current flow on failure of said ballast power factor capacitor, and said surge voltage protection tube comprises a hermetically sealed gas discharge tube having electrodes insulated and spaced a predetermined distance from each other and an inert gas at low pressure, whereby said tube permits current flow only on occurrence of a predetermined voltage drop thereacross.

9. A power reducing attachment according to claim 1 in which said thermally actuated overload switch comprises a normally closed bimetal switch having its contacts in series with said inductor, and an electric heater resistor positioned in close proximity to said bimetal switch and connected from the powered side of said switch to the secondary of said isolation transformer and is operable to heat in response to an excessive flow of current to said ballast transformer resulting from failure of said ballast capacitor to open said bimetal switch contacts, and further including a surge voltage protection tube comprising a hermetically sealed gas discharge tube having electrodes insulated and spaced a predetermined distance from each other and an inert gas at low pressure, whereby said tube permits current flow only on occurrence of a predetermined voltage drop thereacross on failure of said ballast capacitor.

10. In combination, a rapid start fluorescent lighting fixture having at least one fluorescent lamp tube with starter filaments at opposite ends thereof, and an electric circuit therefor comprising a rapid start ballast comprising:

an autotransformer having a primary winding, a secondary winding connected to opposite ends of said lighting tube for maintaining an illuminating flow therethrough once started, and a plurality of step-down filament windings, a first capacitor in circuit between the high voltage output side of said autotransformer and said step down transformer secondary windings, a resistor connected in parallel with said capacitor, power saving means comprising an isolation transformer having a primary connected to the secondary of said step down transformer and a secondary connected to one of said fluorescent lamp filaments, a second capacitor connected between the primary and secondary of said isolation transformer, a resistor connected in parallel with said second capacitor, an inductor connected in series with said primary winding of said autotransformer, and a thermally actuated overload switch connected in series with said inductor and operable to open in response to an excessive flow of current resulting from failure of said ballast capacitor or any thermal overload conditions.

11. A flourescent lighting fixture and circuit therefor according to claim 10 in which said thermally actuated overload switch is connected in series with said inductor and said ballast transformer and is operable to open in response to an excessive flow of current to said ballast transformer resulting from failure of said ballast capacitor or any thermal overload conditions.

12. A fluorescent lighting fixture and circuit therefor according to claim 10 in which said thermally actuated overload switch includes a surge voltage protection tube permitting current flow on failure of said ballast capacitor.

13. A fluorescent lighting fixture and circuit therefor according to claim 10 in which said thermally actuated overload switch is connected in series with said inductor and said ballast transformer and is operable to open in response to an excessive flow of current to said ballast capacitor, and includes a surge voltage protection tube permitting current flow on failure of said ballast capacitor.

14. A fluorescent lighting fixture and circuit therefor according to claim 10 in which said thermally actuated overload switch comprises a normally closed bimetal switch having its contacts in series with said inductor, and an electric heater resistor positioned in close proximity to said bimetal switch and connected from the powered side of said switch to the secondary of said isolation transformer and is operable to heat in response to an excessive flow of current to said ballast capacitor to open said bimetal switch contacts.

15. A fluorescent lighting fixture and circuit therefor according to claim 10 in which said thermally actuated overload switch comprises a normally closed bimetal switch having its contacts in series with said inductor, and an electric heater resistor positioned in close proximity to said bimetal switch and connected from the powered side of said switch to the secondary of said isolation transformer and is operable to heat in response to an excessive flow of current to said ballast transformer resulting from failure of said ballast capacitor to open said bimetal switch contacts, and further including a surge voltage protection tube permitting current flow on failure of said ballast capacitor.

16. A fluorescent lighting fixture and circuit therefor according to claim 12 in which said surge voltage protection tube comprises a hermetically sealed gas discharge tube having electrodes insulated and spaced a predetermined distance from each other and an inert gas at low pressure, whereby said tube permits current flow only on occurrence of a predetermined voltage drop thereacross.

17. A fluorescent lighting fixture and circuit therefor according to claim 10 in which said thermally actuated overload switch is connected in series with said inductor and said ballast transformer and is operable to open in response to an excessive flow of current to said ballast transformer resulting from failure of said ballast capacitor, and includes a surge voltage protection tube permitting current flow on failure of said ballast capacitor or any thermal overload conditions, and said surge voltage protection tube comprises a hermetically sealed gas discharge tube having electrodes insulated and spaced a predetermined distance from each other and an inert gas at low pressure, whereby said tube permits current flow only on occurrence of a predetermined voltage drop thereacross.

18. A fluorescent lighting fixture and circuit therefor according to claim 10 in which said thermally actuated overload switch comprises a normally closed bimetal switch having its contacts in series with said inductor, and an electric heater resistor positioned in close proximity to said bimetal switch and connected from the powered side of said switch to the secondary of said isolation transformer and is operable to heat in response to an excessive flow of current to said ballast transformer resulting from failure of said ballast capacitor to open said bimetal switch contacts, and further including a surge voltage protection tube comprising a hermetically sealed gas discharge tube having electrodes insulated and spaced a predetermined distance from each other and an inert gas at low pressure, whereby said tube permits current flow only on occurrence of a predetermined voltage drop thereacross on failure of said ballast capacitor.

19. A method of reducing power consumption in a rapid start lighting fixture having a rapid start ballast and a conventional rapid start fluorescent lamp tube, where said ballast includes an autotransformer having a primary winding, a secondary winding and a plurality of step-down filament windings, and a capacitor in circuit with the high voltage output side of the autotransformer, said method comprising providing an isolation transformer, connecting the primary of said isolation transformer to one of said step-down filament windings and connecting the secondary of said isolation transformer to one of the fluorescent lamp filaments, providing a capacitor and connecting same between the primary and secondary of said isolation transformer, providing a resistor connecting same in parallel with said last named capacitor, providing an inductor and connecting same in series circuit with said autotransformer, providing a thermally actuated overload switch and connecting the same in series with said inductor operable to open in response to an excessive flow of current resulting from failure of said ballast capacitor or any thermal overload conditions, and said ballast and associated circuit, and said isolation transformer, the capacitor and resistor connected thereto, and said inductor cooperating to produce a relatively square wave output to said fluorescent lamp tube.

20. A method according to claim 19 in which said thermally actuated overload switch is connected in series with said inductor and said ballast transformer and is operable to open in response to an excessive flow of current to said ballast transformer resulting from failure of said ballast capacitor or any thermal overload conditions.

21. A method according to claim 20 in which a surge voltage protection tube is installed with said thermally actuated overload switch permitting current flow on failure of said ballast capacitor.

22. A method according to claim 20 in which said thermally actuated overload switch comprises a normally closed bimetal switch having its contacts in series with said inductor, and an electric heater resistor positioned in close proximity to said bimetal switch and connected from the powered side of said switch to the secondary of said isolation transformer and is operable to heat in response to an excessive flow of current to said ballast transformer resulting from failure of said ballast capacitor to open said bimetal switch contacts.

23. A method according to claim 20 in which said thermally actuated overload switch comprises a normally closed bimetal switch having its contacts in series with said inductor, and an electric heater resistor positioned in close proximity to said bimetal switch and connected from the powered side of said switch to the primary of said isolation transformer and is operable to heat in response to an excessive flow of current to said ballast transformer resulting from failure of said ballast capacitor to open said bimetal switch contacts, and further including providing and installing a surge voltage protection tube in circuit with said electric heater permitting current flow on failure of said ballast capacitor.

24. A method according to claim 23 in which said surge voltage protection tube comprises a hermetically sealed gas discharge tube having electrodes insulated and spaced a predetermined distance from each other and an inert gas at low pressure, whereby said tube permits current flow only on occurrence of a predetermined voltage drop thereacross.

* * * * *